United States Patent [19]

Dreisbach et al.

[11] Patent Number: 4,765,867

[45] Date of Patent: Aug. 23, 1988

[54] PITCH CONTROL PROCESS UTILIZING QUATERNIZED POLYAMINE IONENE POLYMER

[75] Inventors: David D. Dreisbach; Gilbert S. Gomes; Michael A. Schuster, all of Jacksonville, Fla.

[73] Assignee: Betz Laboratories, Inc., Trevose, Pa.

[21] Appl. No.: 881,379

[22] Filed: Jul. 2, 1986

[51] Int. Cl.[4] ..... D21C 3/20

[52] U.S. Cl. ..... 162/72; 162/164.3; 162/164.6; 162/164.6; 162/199; 162/DIG. 4

[58] Field of Search ..... 162/72, 199, 164.3, 162/164.6, DIG. 4, 158

[56] References Cited

U.S. PATENT DOCUMENTS

| | | | |
|---|---|---|---|
| 3,081,219 | 3/1963 | Drennen et al. | 162/72 |
| 3,154,466 | 10/1964 | Nothum | 162/76 |
| 3,582,461 | 6/1971 | Lipowski et al. | 162/72 |
| 3,619,351 | 11/1971 | Kolosh | 162/72 |
| 3,632,507 | 1/1972 | Witt | 210/54 |
| 3,748,220 | 7/1973 | Gard | 162/72 |
| 3,784,649 | 1/1974 | Buckman et al. | 260/874 |
| 3,992,249 | 11/1976 | Farley | 162/72 |
| 4,166,894 | 9/1979 | Schaper | 528/271 |
| 4,184,912 | 1/1980 | Payton | 162/72 |
| 4,190,491 | 2/1980 | Drennen et al. | 162/76 |
| 4,250,269 | 2/1981 | Buckman et al. | 525/6 |
| 4,253,912 | 3/1981 | Becker et al. | 162/76 |

FOREIGN PATENT DOCUMENTS 61-55294 3/1986 Japan .

OTHER PUBLICATIONS

Casey, *Pulp and Paper,* vol. II, 2nd ed., pp. 1096–1097.

Goossens et al., "Flocculation of Microcrystalline Cellulose Suspensions With Cationic Polymers: Effect of Agitation," TAPPI, vol. 59, No. 2, Feb. 1976, pp. 89–94.

May et al., "Aversital, New Polymer for Use in the Manufacture of Paper and Paperboard," Appita, vol. 32, No. 6, May 1979, pp. 466–468.

Louche et al., "The Role of Special Polyelectrolytes for the Solution of Operating Problems in Paper and Board Production," Product Information, Buckman Lab. S.A.

*Primary Examiner*—Peter Chin

*Attorney, Agent, or Firm*—Alexander D. Ricci; Roslyn T. Tobe

[57] ABSTRACT

The invention relates to a process for controlling pitch deposition from pulp in papermaking systems which comprises adding to the pulp an effective amount of a water-soluble quaternized polyamine ionene polymer.

20 Claims, No Drawings

PITCH CONTROL PROCESS UTILIZING QUATERNIZED POLYAMINE IONENE POLYMER

BACKGROUND OF THE INVENTION

1. Field of the Invention

This invention relates to a process for controlling pitch deposition from pulp in papermaking systems.

2. Description of the Prior Art

Pitch deposition can be detrimental to efficient operation of paper mills. Pitch can deposit on process equipment in papermaking systems resulting in operational problems in the systems. Pitch deposits on consistency regulators and other instrument probes can render these components useless. Deposits on screens can reduce throughput and upset operation of the system. Deposition of the pitch can occur not only on metal surfaces in the system, but also on plastic and synthetic surfaces such as machine wires, felts, foils, uhle boxes and headbox components. Pitch deposits may also break off resulting in spots and defects in the final paper product which decrease the paper's quality.

Surfactants, anionic polymers and copolymers of anionic monomers and hydrophobic monomers have been used extensively to prevent pitch deposition of metal soap and other resinous pitch components. See "Pulp and Paper", by James P. Casey, Vol. II, 2nd edition, pp. 1096–7. Bentonite, talc, diatomaceous silica, starch, animal glue, gelatin and alum are known to reduce pitch trouble. U.S. Pat. No. 3,081,219, Drennen et al., discloses the use of a polymeric N-vinyl lactam to control pitch in the making of paper for sulfite pulps. U.S. Pat. No. 3,154,466, Nothum, discloses the use of xylene sulfonic acid-formaldehyde condensates and salts thereof as pitch dispersants in papermaking. The use of napthalene sulfonic acid-formaldehyde condensates for pitch control is also known in the art. U.S. Pat. No. 3,582,461, Lipowski et al., teaches the use of water soluble dicyandiamide-formaldehyde condensates to control pitch. U.S. Pat. No. 3,619,351, Kolosh, discloses process and composition for controlling resin in aqueous cellulose pulp suspensions which comprises incorporating in the suspension a resin control agent comprising a certain water-soluble nonsurface-active cationic quaternary ammonium salt.

Moreover, U.S. Pat. No. 3,748,220, Gard, discloses the use of an aqueous solution of nitrilotriacetic acid sodium salt and a water soluble acrylic polymer to stabilize pitch in paper pulp. U.S. Pat. No. 3,992,249, Farley, discloses the use of certain anionic vinyl polymers carrying hydrophobic-oleophilic and anionic hydrophilic substituents when added prior to the beating operation in the range of about 0.5 part to 100 parts by weight of the polymer per million parts by weight of the fibrous suspension to inhibit the deposition of adhesive pitch particles on the surfaces of pulp-mill equipment. U.S. Pat. No. 4,184,912, Payton, discloses the use of a 3-component composition comprised of 50–20% by weight of a nonionic surfactant, 45–15% by weight of an anionic dispersant, and 45–15% by weight of an anionic polymer having molecular weight less than 100,000. U.S. Pat. No. 4,190,491, Drennen et al., discloses the use of a certain water-soluble linear cationic polymer having a viscosity average molecular weight of about 35,000 to 70,000. Also, U.S. Pat. No. 4,253,912, Becker et al., discloses the use of a certain soluble, chlorine-resistant phosphonate of high calcium tolerance to disperse pitch contained in the aqueous medium of a pulp or papermaking process.

Additionally, sundry ionene-type polymeric compositions are known to be useful as drainage aids, formation aids, retention aids, sizing agents, strength improving agents and flocculants. (See, e.g., U.S. Pat. Nos. 3,632,507, 3,784,649 and 4,166,894.)

SUMMARY OF THE INVENTION

This invention relates to a process for controlling pitch deposition from pulp in papermaking systems which comprises adding to the pulp an effective amount of water-soluble quaternized polyamine ionene polymers. These polymers have positively charged nitrogen atoms in their backbone, which retain their positive charge over a wide pH range. The polymers of this invention can be condensation polymers derived from the condensation polymerization of epichlorohydrin and/or a dihalo alkyl compound with any amine containing or alkylamine containing molecule including, but not limited to, a dialkylamine, a dialkylamino trialkylamine, a dialkylamino alkylamine, ammonia, melamine and/or an alkyldiamine, wherein the alkyl groups of the dialkylamine, dialkylamino trialkylamine, and dialkylamino alkylamine have from 1 to about 5 carbon atoms, the alkyl groups of the dihalo alkyl compound and the alkyldiamine have from 1 to about 20 carbon atoms, and the halogen of the dihalo alkyl compound is selected from the group consisting of bromine, chlorine, and iodine. The polymers of this invention can also be derived from the condensation polymerization of epichlorohydrin and/or the dihalo alkyl compound with combinations of the above-mentioned amine containing, multiamine containing, and ammonia based molecules.

There are several advantages associated with the present invention as compared to prior art processes. These advantages include: an ability to function without being affected by the hardness of the water used in the system unlike certain anionics; an ability. to function with lower foaming than surfactants; an ability. to function while not adversely affecting sizing, fines retention, or pitch retention; an ability. to function with defoamer and oil present; and an ability to function at very low concentrations.

DETAILED DESCRIPTION OF THE INVENTION

The present inventors have discovered that pitch deposition from pulp in papermaking systems can be controlled by adding to the pulp an effective pitch deposition control amount of a water-soluble quaternized polyamine ionene polymer. By the term "quaternized" as used herein, it is meant that at least 10% of the nitrogen atoms responsible for positive charge development in the polymer are covalently bonded to four alkyl groups. Also, by the term "ionene" as used herein, it is meant that the aforementioned nitrogen atoms are part of the backbone of the polymer. The molecular weight of the polymers of this invention can vary over a wide range. Preferably, the molecular weight of these polymers is from about 2,000 to about 2,000,000 and, most preferably, the molecular weight is from about 5,000 to about 500,000. These polymers can have widely varying degrees of linearity and branching. Accordingly, these polymers are most conveniently described in terms of their method of preparation. For example, suitable polymers can be derived or synthesized by condensation polymerization.

In one embodiment, the polymer of this invention can be a condensation polymer derived from the condensation polymerization of epichlorohydrin or a dihalo alkyl compound with a dialkylamine wherein the alkyl groups of the dialkylamine have from 1 to about 5 carbon atoms. Exemplary dialkylamines include dimethylamine, diethylamine, dipropylamine, dibutylamine, and dipentylamine. Preferably, the dialkylamine is dimethylamine or diethylamine. A preferred embodiment of this invention may be derived from the condensation polymerization of epichlorohydrin with dimethylamine. It is further preferred that this embodiment has a molecular weight from about 8,000 to about 14,000.

In another embodiment of this invention, the polymer can be a condensation polymer derived from the condensation polymerization of epichlorohydrin or a dihalo alkyl compound with a dialkylamino trialkylamine wherein the alkyl groups of the dialkylamino trialkylamine have from 1 to about 5 carbon atoms. Exemplary dialkylamino trialkylamines include 1,3-di(dimethylamino)propane; 1,3-di(diethylamino)propane; 1,2-di(dimethylamino)ethane; 1,2-di(diethylamino) ethane; 1,4-di(dimethylamino)butane; and 1,4-di(diethylamino)-butane.

In a further embodiment, the polymer of this invention can be a condensation polymer derived from the condensation polymerization of epichlorohydrin or a dihalo alkyl compound with a dialkylamino alkylamine wherein the alkyl groups of the dialkylamino alkylamine have from 1 to about 5 carbon atoms. Exemplary dialkylamino alkylamines include dimethylamino propylamine, diethylamino propylamine, dimethylamino ethylamine, diethylamino ethylamine, dimethylamino methylamine, dimethylamino butylamine, and diethylamino butylamine. A preferred embodiment may be derived from the condensation polymerization of epichlorohydrin with dimethylamino propylamine. It is further preferred that this embodiment has a molecular weight from about 15,000 to about 25,000.

In another embodiment of this invention, the polymer can be a condensation polymer derived from the condensation polymerization of epichlorohydrin or a dihalo alkyl compound with an alkyldiamine or ammonia wherein the alkyl groups of the alkyldiamine have from 1 to about 20 carbon atoms. A sufficient ratio of the dihalo alkyl compound to the alkyldiamine or ammonia is maintained to provide for quaternization. The polymer can also be formed by beginning with the epichlorohydrin or dihalo alkyl compound and the alkyldiamine or ammonia to form a polymer comprising primarily of secondary amine linkages and then quaternizing this polymer using monohalo alkyl compounds. The preferred alkyldiamines include methyldiamine, ethyldiamine, propyldiamine, butyldiamine, pentyldiamine, hexyldiamine and heptyldiamine.

In an alternate embodiment, the polymer of this invention can be a condensation polymer derived from the condensation polymerization of epichlorohydrin or a dihalo alkyl compound with a dialkylamine and an alkyldiamine wherein the alkyl groups of the dialkylamine have from 1 to about 5 carbon atoms and the alkyl groups of the alkyldiamine have from 1 to about 20 carbon atoms. A preferred embodiment may be derived from the condensation polymerization of epichlorohydrin with dimethylamine and ethylenediamine. It is further preferred that this embodiment has a molecular weight from about 400,000 to about 600,000.

The term "dihalo alkyl compound" as used herein means a hydrocarbon based molecule having 1 to 20 carbon atoms and two covalently-bonded halogen molecules, preferably in primary positions. The halogen of the dihalo alkyl compound is selected from the group consisting of bromine, chlorine, and iodine. Preferably, the halogen is chlorine. Additionally, the alkyl group of the dihalo alkyl compound has from 1 to about 20 carbon atoms and, preferably, the alkyl group has from 1 to about 7 carbon atoms. Exemplary dihalo alkyl compounds include 1,2-dichloroethane; 1,3-dichloropropane; 1,4-dichlorobutane; 1,5-dichloropentane; and 1,6-dichlorohexane.

The polymers of the instant invention are effective in controlling pitch deposition in papermaking systems, such as Kraft, acid sulfite, and groundwood papermaking systems. For example, pitch deposition in the brown stock washer, screen room and decker systems in Kraft papermaking processes can be controlled. The term "papermaking system" is meant to include all pulp processes. Generally, it is thought that these polymers can be utilized to prevent pitch deposition on all wetted surfaces from the pulp mill to the reel of the paper machine under a variety of pH's and conditions. More specifically, these polymers effectively decrease the deposition of metal soap and other resinous pitch components not only on metal surfaces, but also on plastic and synthetic surfaces such as machine wires, felts, foils, uhle boxes and headbox components.

The polymers of the present invention can be added to the pulp at any stage of the papermaking system. The polymers can be added in dry particulate form or as a dilute aqueous solution. The effective amount of these polymers to be added depends on the severity of the pitch problem which often depends on a number of variables, including the pH of the system, hardness, temperature, and the pitch content of the pulp. Generally between 0.5 ppm and 150 ppm of the polymer is added based on the weight of the pulp slurry.

The invention will be further illustrated by the following examples which are included as being illustrations of the invention and should not be construed as limiting the scope thereof.

EXAMPLES

It was found that pitch could be made to deposit from a 0.5% consistency fiber slurry containing approximately 2000 ppm of a laboratory pitch by placing the slurry into a metal pan suspended in a laboratory ultrasonic cleaner water bath. The slurry contained 0.5% bleached hardwood Kraft fiber, approximately 2000 ppm of a fatty acid blend as the potassium salt, approximately 500 ppm calcium expressed as calcium carbonate from calcium chloride and approximately 300 ppm sodium carbonate. The slurry was maintained at 50° C. and a pH of 11.0. It was stirred gently by an overhead stirrer and subjected to ultrasonic energy for 10 minutes. The deposit was determined by the difference between the starting weight of the metal pan and the oven dried weight of the pan plus the deposit after the completion of test. Results are reported in Table I.

TABLE I

| Treatment | Deposit Weight |
|---|---|
| Control | 686 mg |

TABLE I-continued

| Treatment | | Deposit Weight |
|---|---|---|
| 10 ppm | Quaternized Polyamine Ionene Polymer: Condensation product of DMA/EPI ($8-14 \times 10^3$ MW) | 44 mg |
| 10 ppm | Quaternized Polyamine Ionene Polymer: Condensation product of DMAPA/EPI ($15-25 \times 10^3$ MW) | 26 mg |
| 10 ppm | Quaternized Polyamine Ionene Polymer Condensation product of DMA/EPI/EDA ($400-600 \times 10^3$ MW) | 64 mg |

DMA = Dimethylamine
EPI = Epichlorohydrin
DMAPA = Dimethylamino propylamine
EDA = Ethylenediamine The results shown in Table I demonstrate that polymers in accordance with this invention are effective in controlling pitch deposits from pulp in a test designed to simulate brown stock washer/screen from Kraft pitch deposition. These results further indicate that the polymers are effective in controlling pitch deposition on metal surfaces and under alkaline conditions.

Additionally it was found that pitch having a composition similar to that of Southern pine extractables could be made to deposit from a 0.5% consistency pulp slurry containing 350 ppm pitch onto a plastic surface by stirring the slurry at a high rate using a blender. The slurry contained 0.5% bleached hardwood Kraft fiber, approximately 350 ppm pitch having fatty acids, resin acids, fatty esters and sterols in the approximate ratio of Southern pine extractables and 200 ppm calcium expressed as calcium derived from calcium chloride. The slurry was maintained at a pH of 4.0. A plastic coupon was fashioned and attached to the metal blender base. The pulp slurry was added to the blender and stirred for 5 minutes. The plastic coupon was then air dried and the deposit was determined by the difference between the clean and deposit laden weight of the plastic coupon. The results are reported in Table II.

TABLE II

| Treatment | | *% Control of Deposit |
|---|---|---|
| 1 ppm | Quaternized Polyamine Ionene Polymer: Condensation product of DMA/EPI ($8-14 \times 10^3$ MW) | 86% |
| 1 ppm | Quaternized Polyamine Ionene Polymer: Condensation product of DMAPA/EPI ($15-25 \times 10^3$ MW) | 91% |
| 1 ppm | Quaternized Polyamine Ionene Polymer: Condensation product of DMA/EPI/EDA ($400-600 \times 10^3$ MW) | 91% |
| 1 ppm | Dicyandiamide-formaldehyde Resin | 68% |
| 1 ppm | Melamine | 40% |

DMA = Dimethylamine
EPI = Epichlorohydrin
DMAPA = Dimethylamino propylamine
EDA = Ethylenediamine
*% Control of Deposit =

$$\frac{\text{(Untreated deposit wt.)} - \text{(Treated deposit wt.)}}{\text{(Untreated deposit wt.)}} \times 100$$

The results reported in Table II indicate that polymers of this invention are effective in preventing pitch deposition on plastic surfaces. These results further indicate that the polymers may be effectively utilized under acidic conditions which might occur during any acid fine, linerboard, and groundwood papermaking operation. The Table II results further show that the polymers of this invention are surprisingly far superior pitch control agents than known pitch control agents such as dicyandiamide-formaldehyde resin.

It is common for many pulp mills to use large quantities of oil-based defoamers as drainage aids. These defoamers usually have considerable impact in aggravating pitch deposition. Furthermore, it is known that the defoamers can have a considerable negative impact on the ability of previously known pitch control agents to function effectively. It was found that by adding 430 ppm of an oil-based brown stock defoamer during the Kraft pitch deposition test, which is described in the procedure for Table I, the abovedescribed effect could be demonstrated. It was further found that the polymers of this invention were surprisingly tolerant of the presence of the oil-based defoamers, as demonstrated by the results reported in Table III. All materials tested were fed so that they achieved approximately 80% control or more in the absence of defoamer.

TABLE III

| Treatment | | *% Control of Deposit | |
|---|---|---|---|
| | | Without Defoamer | With Defoamer |
| 27.6 ppm | Quaternized Polyamine Ionene Polymer: Condensation product of dimethylamine/epichlorohydrin ($8-14 \times 10^3$ MW) | 98% | 96% |
| 40 ppm | Nonyl Phenol, 8.4 moles Ethylene Oxide | 80% | 33% |
| 55.2 ppm | $C_{14}$ to $C_{15}$ fatty Alcohol, 11.9 moles Ethylene Oxide | 84% | 37% |
| 36 ppm | Polyacrylate (250,000 MW) | 87% | 70% |

*% Control of Deposit =

$$\frac{\text{(Untreated deposit wt.)} - \text{(Treated deposit wt.)}}{\text{(Untreated deposit wt.)}} \times 100$$

A mill trial was conducted at a Southern bleached Kraft mill experiencing severe deposition conditions in the screen room and feeding defoamer at levels as high as 12 pounds per ton of pulp. The trial involved feeding product to the brown stock or screen room/decker area and monitoring deposit control by the weight of pitch scraped daily from a steel plate at a point downstream of the product addition. Results are reported in Table IV.

TABLE IV

| Trial Treatment Method (Time Period) | *Pre-Trial Baseline (Range/Ave) | *Trial Data (Range/Ave) | *Post-Trial Baseline (Range/Ave) | % Control By Treatment |
|---|---|---|---|---|
| **Custom Sperse ® 1035 (10/16-11/26/84) | 28.9-57.5/ 35 | 7.2-55.3/ 26.9 | Not Available | 23% |
| Quaternized Polyamine Ionene Polymer: Product | 9.0-40.1/ 27.7 | 4.8-15.5/ 11.3 | 13-55.3/ 27.5 | 60% |

TABLE IV-continued

| Trial Treatment Method (Time Period) | *Pre-Trial Baseline (Range/Ave) | *Trial Data (Range/Ave) | *Post-Trial Baseline (Range/Ave) | % Control By Treatment |
|---|---|---|---|---|
| of Dimethylamine/ Epichlorohydrin, 8–14 × $10^3$ MW (7/15–8/1/85) | | | | |

*Numbers represent grams of pitch deposited in a 24 hour period and scraped from a stationary stainless steel surface submerged in a pulp stream. (Pitch plate.)
**Proprietary blend of surfactants and dispersants available from Betz PaperChem, Inc.

Tests were also conducted to study pitch retention. The pitch solution and fiber for addition were prepared as described in the procedure for Table I. However, rather than using an ultrasound, the diluted slurry was added to a beaker. A stirrer was then connected and the contents stirred for 10 minutes. Then the slurry was dumped from the beaker into a Buchner funnel with machine wire in the bottom. Water was allowed to drain under gravity and then the full vacuum was pulled on the pulp pad. The pad was soxhlet extracted to determine the soluble organic content. Results are reported in Table V.

TABLE V

| Treatment | % Soluble Organics in Pulp Pad |
|---|---|
| Control 1 (untreated) | 3.2% |
| Control 2 (untreated) | 3.0% |
| Quaternized Polyamine Ionene Polymer: Condensation product of DMA/EPI/EDA (400–600 × $10^3$ MW) | 22% |

DMA = Dimethylamine
EPI = Epichlorohydrin
EDA = Ethylenediamine

The results reported in Table V indicate that water-soluble quaternized polyamine ionene polymers flocculate and retain pitch and, therefore, they will have no negative effect on pitch retention.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for controlling pitch deposition from pulp in paper-making systems wherein said pitch deposition is a problem which comprises adding to the pulp an effective amount of about 0.5 ppm to about 150 ppm based on the weight of the pulp of a water-soluble quaternized polyamine ionene polymer to control said pitch deposition.

2. The process of claim 1 wherein the polymer has a molecular weight from about 2,000 to about 2,000,000.

3. The process of claim 2 wherein the polymer has a molecular weight from about 5,000 to about 500,000.

4. The process of claim 1 wherein the polymer is a condensation polymer.

5. The process of claim 4 wherein the polymer is derived from the condensation polymerization of epichlorohydrin with a dialkylamine wherein the alkyl groups have from 1 to about 5 carbon atoms.

6. The process of claim 5 wherein the dialkylamine is dimethylamine.

7. The process of claim 6 wherein the polymer has a molecular weight from about 8,000 to about 14,000.

8. The process of claim 4 wherein the polymer is derived from the condensation polymerization of epichlorohydrin with a dialkylamino trialkylamine wherein the alkyl groups have from 1 to about 5 carbon atoms.

9. The process of claim 4 wherein the polymer is derived from the condensation polymerization of epichlorohydrin with a dialkylamino alkylamine wherein the alkyl groups have from 1 to about 5 carbon atoms.

10. The process of claim 9 wherein the dialkylamino alkylamine is dimethylamino propylamine.

11. The process of claim 10 wherein the polymer has a molecular weight from about 15,000 to about 25,000.

12. The process of claim 4 wherein the polymer is derived from the condensation polymerization of epichlorohydrin with an alkyldiamine or ammonia wherein the alkyl group has from 1 to about 20 carbon atoms.

13. The process of claim 4 wherein the polymer is derived from the condensation polymerization of epichlorohydrin with a dialkylamine and an alkyldiamine, wherein the alkyl groups of the dialkylamine have from 1 to about 5 carbon atoms and the alkyl groups of the alkyldiamine have from 1 to about 20 carbon atoms.

14. The process of claim 13 wherein the dialkylamine is dimethylamine and the alkyldiamine is ethylenediamine.

15. The process of claim 14 wherein the polymer has a molecular weight from about 400,000 to about 600,000.

16. The process of claim 4 wherein the polymer is derived from the condensation polymerization of a dihalo alkyl compound with a dialkylamine, wherein the alkyl groups of the dialkylamine have from 1 to about 5 carbon atoms, the alkyl groups of the dihalo alkyl compound have from 1 to about 20 carbon atoms, and the halogen of the dihalo alkyl compound is selected from the group consisting of bromine, chlorine, and iodine.

17. The process of claim 4 wherein the polymer is derived from the condensation polymerization of a dihalo alkyl compound with a dialkylamino trialkylamine, wherein the alkyl groups of the dialkylamino trialkylamine have from 1 to about 5 carbon atoms, the alkyl groups of the dihalo alkyl compound have from 1 to about 20 carbon atoms, and the halogen of the dihalo alkyl compound is selected from the group consisting of bromine, chlorine, and iodine.

18. The process of claim 4 wherein the polymer is derived from the condensation polymerization of a dihalo alkyl compound with a dialkylamino alkylamine, wherein the alkyl groups of the dialkylamino alkylamine have from 1 to about 5 carbon atoms, the alkyl groups of the dihalo alkyl group have from 1 to about 20 carbon atoms, and the halogen of the dihalo alkyl compound is selected from the group consisting of bromine, chlorine, and iodine.

19. The process of claim 4 wherein the polymer is derived from the condensation polymerization of a dihalo alkyl compound with an alkyldiamine or ammonia, wherein the alkyl groups of the alkyldiamine and the dihalo alkyl compound have from 1 to about 20 carbon atoms, and the halogen of the dihalo alkyl compound is selected from the group consisting of bromine, chlorine, and iodine.

20. The process of claim 4 wherein the polymer is derived from the condensation polymerization of a dihalo alkyl compound with a dialkylamine and an alkyldiamine, wherein the alkyl groups of the dialkylamine have from 1 to about 5 carbon atoms, the alkyl groups of the dihalo alkyl compound and alkyldiamine have from 1 to about 20 carbon atoms, and the halogen of the dihalo alkyl compound is selected from the group consisting of bromine, chlorine, and iodine.

* * * * *